US012751566B2

(12) United States Patent
Picardo, III

(10) Patent No.: US 12,751,566 B2
(45) Date of Patent: Oct. 6, 2026

(54) VERTICAL MOUNTING ASSEMBLY

(71) Applicant: AMERICANFLAT CORPORATION, New York, NY (US)

(72) Inventor: John James Picardo, III, Palm Beach Gardens, FL (US)

(73) Assignee: AMERICANFLAT CORPORATION, New York, NY (US)

( * ) Notice: Subject to any disclaimer, the term of this patent is extended or adjusted under 35 U.S.C. 154(b) by 0 days.

(21) Appl. No.: 18/794,619

(22) Filed: Aug. 5, 2024

(65) Prior Publication Data

US 2025/0380827 A1 Dec. 18, 2025

Related U.S. Application Data

(63) Continuation-in-part of application No. 29/947,931, filed on Jun. 18, 2024, and a continuation-in-part of application No. 29/947,217, filed on Jun. 13, 2024, now abandoned.

(51) Int. Cl.
*A47G 1/16* (2006.01)

(52) U.S. Cl.
CPC ..... *A47G 1/1606* (2013.01)

(58) Field of Classification Search
CPC ..... A47G 1/1606; A47G 1/16; A47F 7/14; A47H 1/10
USPC ..... 248/497, 489, 466, 475.1
See application file for complete search history.

(56) References Cited

U.S. PATENT DOCUMENTS

| | | | | | |
|---|---|---|---|---|---|
| 2,395,191 | A | | 2/1946 | Newman | |
| 3,804,360 | A | | 4/1974 | Stecker | |
| 3,965,600 | A | | 6/1976 | Paskerian | |
| 4,309,017 | A | | 1/1982 | Slemmons | |
| 4,458,873 | A | | 7/1984 | Sutherland | |
| D279,431 | S | | 7/1985 | Sutherland | |
| 4,530,482 | A | | 7/1985 | Berinson | |
| 4,883,247 | A | * | 11/1989 | Crandall | A47G 1/1613 248/495 |
| D305,703 | S | | 1/1990 | Wang | |
| 4,973,021 | A | * | 11/1990 | Schuite | A47G 1/1686 248/327 |
| 5,209,449 | A | * | 5/1993 | Hart | A47G 1/1606 248/475.1 |
| 5,303,895 | A | | 4/1994 | Hart | |
| 5,636,825 | A | | 6/1997 | Pernas | |
| 5,961,090 | A | * | 10/1999 | Parkin | A47G 1/1606 248/475.1 |

(Continued)

FOREIGN PATENT DOCUMENTS

WO WO2025259302 12/2025

*Primary Examiner* — Muhammad Ijaz
(74) *Attorney, Agent, or Firm* — Malloy & Malloy, P.L.; Peter Matos

(57) ABSTRACT

A vertical mounting assembly that allows for effortless, secure, and versatile hanging of wall/vertical surface mounted frames, pictures, mirrors, or similar items (described as décor herein). The instant assembly features a two-piece design, consisting of a mounting bracket and anchoring receiver, requiring only one tool for installation and the subsequent hanging of wall/vertical surface décor. The instant assembly further allows for precise alignment, prevents décor from becoming crooked or unbalanced, and allows for décor to become quickly re-oriented on a wall/vertical surface.

17 Claims, 7 Drawing Sheets

(56) References Cited

U.S. PATENT DOCUMENTS

| | | | | |
|---|---|---|---|---|
| 6,053,468 | A * | 4/2000 | Francis | A47G 1/1686 248/475.1 |
| 6,286,802 | B1 * | 9/2001 | Munson | A47G 1/1606 248/475.1 |
| 6,322,039 | B1 * | 11/2001 | De Luccia | A47G 1/168 248/231.91 |
| D483,955 | S | 12/2003 | Herman | |
| 7,802,769 | B1 * | 9/2010 | Lindsey | A47G 1/205 248/475.1 |
| 8,297,571 | B2 * | 10/2012 | Xue | F16M 11/10 248/220.22 |
| 9,151,441 | B2 * | 10/2015 | Wheeler | A47G 1/1613 |
| 9,462,717 | B1 | 10/2016 | Senatori | |
| 9,521,915 | B1 * | 12/2016 | Tanger | A47G 1/1606 |
| 9,609,964 | B1 * | 4/2017 | Munson | F16M 13/02 |
| 10,900,239 | B1 * | 1/2021 | Bilge | E04F 13/083 |
| 11,129,450 | B1 * | 9/2021 | Mancini | A44B 11/258 |
| D949,672 | S | 4/2022 | French | |
| 11,399,641 | B1 * | 8/2022 | Garriott | A47G 1/1606 |
| 12,070,140 | B1 * | 8/2024 | Miller | A47G 1/1606 |
| 12,085,104 | B1 * | 9/2024 | Doran | F16B 2/14 |
| 2002/0166939 | A1 * | 11/2002 | Plein, II | A47G 1/1606 248/496 |
| 2002/0179805 | A1 * | 12/2002 | DeLine | A47G 1/1606 248/542 |
| 2003/0038222 | A1 * | 2/2003 | Holmes | A47G 1/1606 248/490 |
| 2005/0006554 | A1 * | 1/2005 | DeLine | A47G 1/1633 248/475.1 |
| 2005/0072894 | A1 * | 4/2005 | Grant | A47B 95/008 248/475.1 |
| 2005/0109910 | A1 | 5/2005 | Vander Berg et al. | |
| 2006/0186304 | A1 | 8/2006 | McGee | |
| 2009/0050775 | A1 * | 2/2009 | Constantinou | A47G 1/1606 248/489 |
| 2015/0342372 | A1 | 12/2015 | Chafe | |
| 2021/0059439 | A1 | 3/2021 | Okerstrom et al. | |
| 2022/0211194 | A1 * | 7/2022 | Malott | A47G 1/1606 |
| 2023/0200570 | A1 | 6/2023 | Spiro et al. | |
| 2023/0389728 | A1 * | 12/2023 | Duran | A47G 1/205 |

* cited by examiner

VERTICAL MOUNTING ASSEMBLY

CROSS REFERENCE TO RELATED APPLICATION(S)

This application claims the benefit under 37 C.F.R § 1.78(d) to U.S. Design Patent Applications having Ser. No. 29/947,217, filed on Jun. 13, 2024 and Ser. No. 29/947,931, filed on Jun. 18, 2024. The above applications are incorporated by reference herein in their entirety.

BACKGROUND

Field

The present disclosure relates to the field of mounting systems. More specifically, the present disclosure relates to mounting assemblies for hanging frames, pictures, mirrors, or similar items (described as décor herein) on walls or vertical surfaces. More particularly, the disclosure pertains to mounting assemblies that facilitate easy, secure, and versatile installation of wall décor/décor affixed to vertical surfaces.

Description of the Related Art

Traditional nail and hook methods for hanging décor on walls present several challenges. One of the primary issues with this method is the lack of precision. Aligning the nail correctly to ensure the décor hangs level is often difficult, and mistakes can result in multiple holes in a wall, causing unsightly damage. Additionally, traditional nail and hook setups do not provide a secure attachment, making décor susceptible to becoming crooked or falling off a wall if bumped. The need for additional tools, such as a level and a measuring tape, complicates the installation process further, often requiring the assistance of another person to achieve satisfactory results.

Sawtooth hangers, while relatively easy to install, also suffer from significant drawbacks. These small metal brackets with serrated edges are attached to the back of the décor but do not offer the same level of stability and security as more advanced systems. Décor hung with sawtooth hangers can easily become unbalanced and sway over time, detracting from the aesthetic presentation. Furthermore, sawtooth hangers do not include built-in leveling features, necessitating the use of additional tools and increasing the complexity of the hanging process.

Wire hanging systems add another layer of complexity to the process of mounting décor. These systems require careful measuring, aligning, and securing of the wire to hooks or nails on the wall. The need for precise measurements and alignment can be time-consuming and frustrating, especially for larger décor or heavier items. Moreover, wire hanging systems often result in décor that is not perfectly level or secure, as the wire can stretch or slip over time, leading to a crooked appearance and the potential for décor to fall.

Velcro, hook and loop, or Command strips offer an adhesive-based alternative to traditional hanging methods but come with their own set of problems. While they eliminate the need for nails or screws, these methods/hanging means may not be suitable for heavier décor, as the adhesive can weaken over time, causing the décor to detach from the wall. Additionally, removing these hangings can damage wall surfaces, causing paint, drywall, or other wall components to peel. The inability to support heavier décor and the potential for wall damage make these hanging means a less than ideal solution for many users.

French cleats are a more robust option, providing a more secure and stable method for hanging. However, traditional French cleats still have limitations. The décor rests on top of the cleat, which can make precise leveling difficult without additional tools. The installation process for French cleats often requires multiple tools and careful alignment, which can be cumbersome and time-consuming. Additionally, French cleats do not allow for quick interchangeability between vertical and horizontal display orientations, limiting their versatility. The bulky nature of traditional French cleats can also detract from the aesthetic appeal of the hanging system. Further, French cleats generally do not support the décor resting atop the cleats when forces are applied to the décor's extremities and to the décor in general, which may cause the décor to lean or tilt to one side of the cleat, which could lead to the décor detaching or otherwise falling from the cleat.

Beyond these specific methods of hanging or affixing décor to a wall or vertical surface, there are general issues associated with the process of hanging décor and similar items on walls. Many traditional systems leave visible damage on walls, such as large holes or adhesive residue. Achieving a perfectly level and stable hanging can be challenging, often requiring multiple attempts and adjustments. The need for additional tools and precise measurements can be a barrier for individuals seeking a simple and efficient solution. Furthermore, traditional systems often lack flexibility, making it difficult to adjust the position or orientation of the décor without starting the installation process over.

Décor that is hung using traditional methods can also be prone to swaying or becoming unbalanced over time. This can occur due to the fulcrum(s) created by (a) nail(s) or hook(s), which allows décor to move easily if bumped. Unbalanced décor detracts from the overall aesthetic and can be frustrating to maintain. Additionally, the need for a second person to assist with the installation process is a common inconvenience, particularly for larger décor or more complex hanging systems.

Continuing, perhaps the most unsightly issue with traditional hanging methods is how décor may not appear flush when mounted to a wall/vertical surface. Indeed, it is common for décor to be unparallel to a wall when hung on traditional hanging methods, or appear as having portions that are spaced from the wall while other portions of the décor are in contact with the wall. In effect, décor can appear slanted when viewed from the side, and/or as if the décor is only supported from a single point above a mid-line of the décor.

The use of multiple tools for installation, such as a pencil, measuring tape, level, hammer, and often an extra person, complicates the process and increases the potential for errors. This complexity can deter individuals from attempting to hang décor themselves, leading to reliance on professional services or suboptimal hanging solutions. The lack of integrated features in traditional systems, such as built-in levels or secure mounting brackets, further exacerbates these issues, making it difficult to achieve a professional-looking result without significant effort and expertise.

In addition to these functional problems, traditional hanging systems can also fall short in terms of aesthetics. Bulky or visible hanging hardware can detract from the appearance of the décor. The lack of a flush fit against the wall can create unsightly gaps, further diminishing the visual appeal. The integration of branded elements and professional touches is often missing in traditional systems, which can leave the final presentation looking amateurish or incomplete.

Given these numerous problems associated with current hanging solutions, there is a clear need for an improved system that addresses these issues. An ideal solution would simplify the installation process, ensure precise alignment and stability, minimize wall damage, and offer flexibility in décor orientation and positioning. By overcoming the limitations of traditional methods, such a system would provide a superior hanging experience for users, enhancing both functionality and aesthetic appeal.

SUMMARY

The present disclosure provides for and describes a vertical mounting assembly that simplifies the process of installing décor on walls or vertical surfaces. In fact, the assembly can have features that ensure precise alignment, leveling, and stability for both the assembly itself and mounting décor, with the ability to minimize wall damage during installation and removal. Additionally, the assembly is adaptable for use with various types of décor, allowing for décor to be mounted at multiple orientations and/or positionings. Further, the assembly may be preinstalled on décor, or may be reoriented on décor to quickly and easily alter the orientation of décor on a wall and/or vertical surface.

Therefore, the present disclosure provides for a vertical mounting assembly that May comprise a moveable bracket comprising a "U" shaped lip and an anchoring receiver configured and dimensioned to receive the moveable bracket. The moveable bracket can comprise at least two flush fit tabs that are spaced apart by a recessed groove. As such, the anchoring receiver May comprise at least two flush fit grooves spaced apart by a protruding tab where the at least two flush fit grooves are configured and dimensioned to receive the at least two flush fits tabs and where the protruding tab is configured and dimensioned to fill the recessed groove (when the moveable bracket is inserted into the anchoring receiver). Notably, the width of the at least two flush fit grooves spaced apart by the protruding tab may be equal to the width of the at least two flush fit tabs and recessed groove. This equal width may be dimensioned to ensure a flush fit between the grooves and tabs, and to allow the grooves and tabs to resist forces applied to décor that May ultimately be affixed to or operatively connected to the mounting assembly, as will be described.

Further, considering the moveable bracket, the bracket may comprise a flat surface on a side of the "U" shaped lip wherein the flat surface is configured and dimensioned to receive a logo. Continuing, regarding the at least two flush fit tabs and recessed groove, this structure may run vertically parallel to the flat surface upon at least one side of the "U" shaped lip configured and dimensioned to receive a logo. Also, the moveable bracket may further comprise a flat surface upon at least one side of the "U" shaped lip configured and dimensioned to be tucked behind a portion of décor, such as, behind the backboard of a frame, should the décor be a frame. As such, the "U" shaped lip may be configured and dimensioned to receive a portion of décor.

Regarding the anchoring receiver, the receiver may comprise at least one stabilizer on each side of the structure formed by the said at least two flush fit grooves spaced apart by the protruding tab. The at least one stabilizer can comprise an aperture configured and dimensioned to receive a fastener, and each stabilizer may further comprise a chamfered, load bearing geometry. In addition, the anchoring receiver may further comprise a tool receiver wherein the tool receiver is configured and dimensioned to receive a leveling device.

Notably, the vertical mounting assembly may be formed from sustainable materials, for example, the moveable bracket and the anchoring receiver can be formed of environmentally friendly or biodegradable materials.

As a vertical mounting assembly can take a few different forms, the vertical mounting assembly may also be comprised of a moveable bracket comprising a first surface and a second surface wherein the first surface is parallel to and operatively connected to the second surface via a perpendicular surface. In this instance, the vertical mounting assembly can also include an anchoring receiver configured and dimensioned to receive a moveable bracket. Here, the first surface of the moveable bracket can comprise at least two flush fit tabs spaced apart by a recessed grove where the anchoring receiver comprises at least two flush fit grooves spaced apart by a protruding tab, wherein at least two flush fit grooves are configured and dimensioned to receive the at least two flush fit tabs and where the protruding tab is configured and dimensioned to fill the recessed groove. Such a configuring and dimensioning can thus allow the grooves and tabs to resist forces applied to décor that may ultimately be affixed to or operatively connected to the mounting assembly, as will be described. Regarding the second surface (of the moveable bracket), the second surface may further comprise a bonding surface on at least one side of the second surface, and/or the second surface may further comprise at least one aperture to allow for a fastener to pass through the second surface and affix the moveable bracket to at least a portion of décor. Regarding the anchoring receiver, here, the receiver may again comprise at least one stabilizer on each side of the structure formed by the at least two flush fit grooves spaced apart by the protruding tab. The at least one stabilizer may comprise at least one aperture that is configured and dimensioned to receive a fastener (to allow the receiver to affix to a wall or vertical surface), and the at least one stabilizer may comprise a chamfered, load bearing geometry.

These and other objects, features and advantages of the present invention will become clearer when the drawings as well as the detailed description are taken into consideration.

BRIEF DESCRIPTION OF THE DRAWINGS

For a fuller understanding of the nature of the present disclosure, reference should be had to the following detailed description taken in connection with the accompanying drawings in which.

Like reference numerals refer to like parts throughout the several views of the drawings.

DETAILED DESCRIPTION

Figure 1:
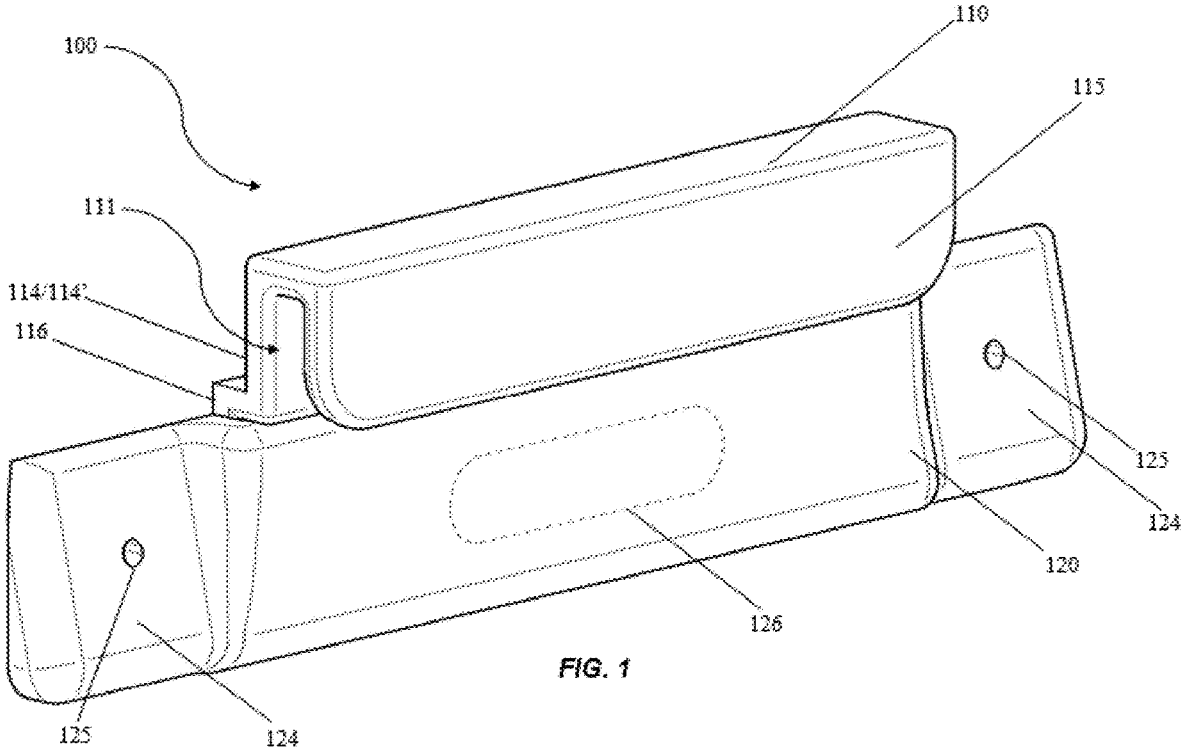
FIG. 1 is a front perspective view of a vertical mounting assembly with a moveable bracket inserted into an anchoring receiver.

With reference now to the Figures, FIG. 1 is a front perspective view of a vertical mounting assembly 100 with a moveable bracket 110 inserted into an anchoring receiver 120. With brief reference to FIG. 9, which depicts a front, exploded perspective view of a vertical mounting assembly 100, the moveable bracket 110 is seen as being able to be disengaged from the anchoring receiver 120. As such, the anchoring receiver 120 may be able to receive at least a portion of the moveable bracket 110. As such, a vertical mounting assembly 100 can be made up of a moveable bracket 110, anchoring receiver 120, and various other elements.

Figure 9:
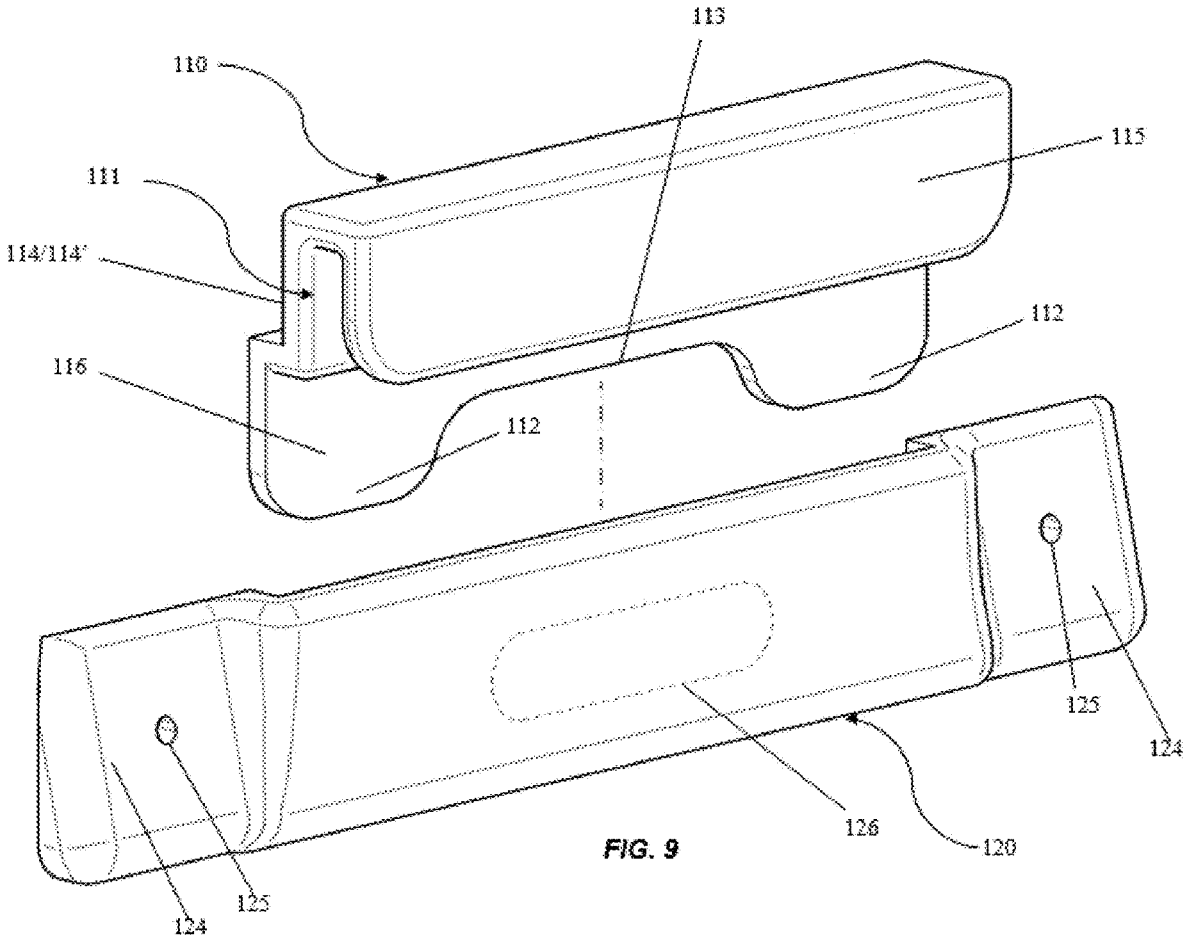
FIG. 9 is a front, exploded view of the vertical mounting assembly of the Figures above with a moveable bracket disengaged from an anchoring receiver.

With continued reference to FIGS. 1 and 9, the vertical mounting assembly 100 can be described as having two main components, a moveable bracket 110 and an anchoring receiver 120. With reference to the moveable bracket 110, the moveable bracket 110 may take various forms, such as with a "U" shaped lip 111 (as will be described) or without a "U" shaped lip 111 (instead with a second surface 114' comprising either a bonding surface 114A, at least one aperture for a fastener 114F, or both). Considering the moveable bracket 110 with a "U" shaped lip 111, the moveable bracket 110 may be comprised of a "U" shaped lip 111, flush fit tabs 112, a recessed groove 113, a flat surface to receive a logo 114 (which can also be described as a second surface 114'), a flat surface to be tucked behind a portion of décor 115, and a first surface 116.

With regard to the "U" shaped lip 111, the "U" shaped lip 111 may be formed by and between the flat surface to be tucked behind a portion of décor 115 and the second surface 114'. As may be apparent, the "U" shaped lip 111 may have a configuration and dimensioning that allows for the lip 111 to take the shape of a "U" or a shape of a rectangle that is open at one of its sides. The lip 111 may thus be configured and dimensioned to receive a portion of décor. Such a portion of décor may be the backing to a frame (commonly known as a backing board or a mat board), wherein the backing of the frame may be inserted and received by the lip 111. Notably, such a feature allows for a user of the instant assembly 100 to thus quickly detach the lip 111 from a portion of décor and re-attach the lip 111 to another portion of the décor so as to reorient the moveable bracket 110 about the décor, allowing décor to be quickly reoriented about a wall or vertical surface, when the instant assembly 100 is used on or affixed to décor. As one might imagine, this can allow for inherent simplicity in the design, such that even a child might be able to alter the orientation of décor on a wall/vertical surface, especially if the décor is specifically designed/marketed to showcase children's artwork. As such, as may now be apparent, one feature of the "U" shaped lip 111 is that it allows a moveable bracket 110 to become attached to, affixed to, or otherwise in retaining contact with a portion of décor, the portion of décor able to be backing to a frame.

Figure 10:
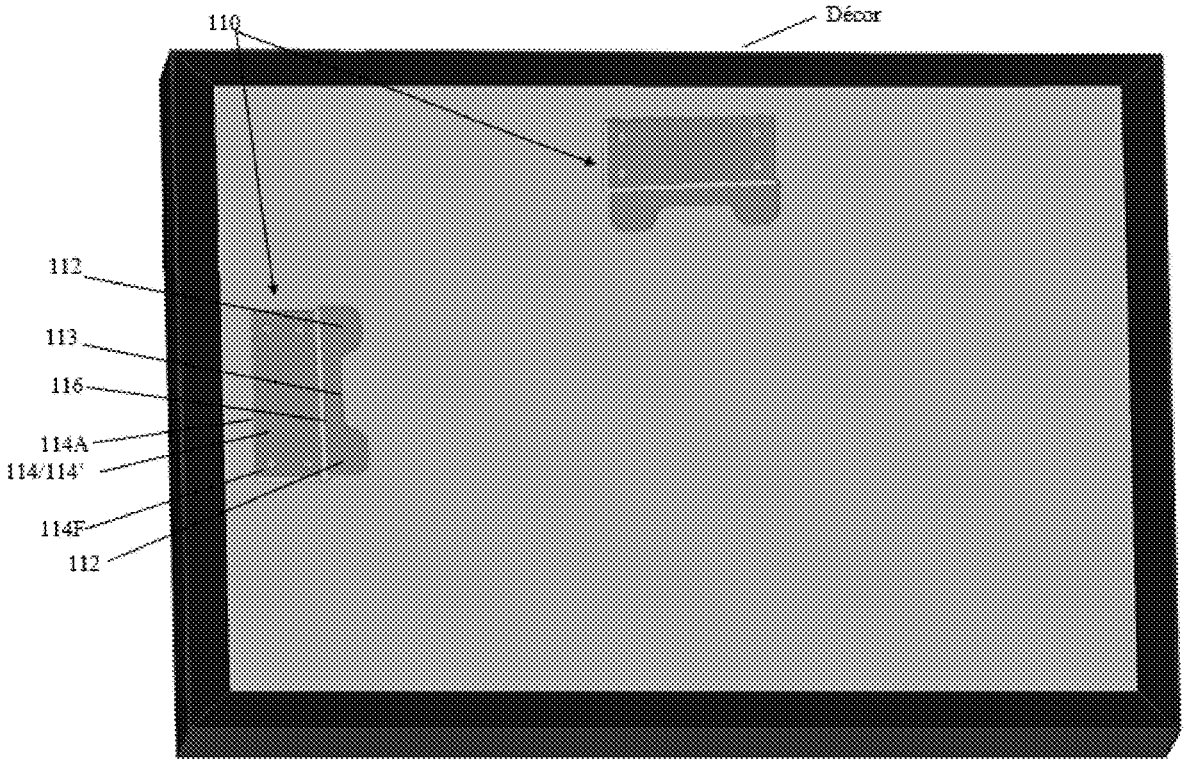
FIG. 10 is a perspective view of two portions of vertical mounting assemblies, distinct from the Figures above, wherein moveable brackets of the vertical mounting assemblies are affixed to a portion of décor.

As described above, a moveable bracket 110 need not comprise a "U" shaped bracket 111, but instead may comprise a second surface 114' comprising either a bonding surface 114A, at least one aperture for a fastener 114F, or both. As such, instead of a moveable bracket 110 comprising a "U" shaped bracket 111, the moveable bracket 110 may be "cut off" (where, for visualization purposes, reference may be had to FIG. 9) at the second surface 114' where the second surface 114' may have apertures therein 114F or a bonding surface 114A applied thereto to allow the moveable bracket 110 to become attached to, affixed to, or otherwise come in retaining contact with a portion of décor. As may be apparent in an instance where a moveable bracket 110 has no "U" shaped lip 111, and where the second surface 114' has an aperture 114F therethrough, the aperture 114F may allow a fixator/fastener (such as a screw or rivet), to pass through the aperture 114F and connect to a portion of décor, in turn, connecting the moveable bracket 110 to décor. Also, in an instance where a moveable bracket 110 has no "U" shaped lip 111, and where the second surface 114' has a bonding surface 114A applied thereto, the bonding surface 114A May allow the moveable bracket 110 to stick to a portion of décor (perhaps through an adhesive or comparable substance), in turn, connecting the moveable bracket 110 to décor. As previously mentioned, as a moveable bracket 110 with no "U" shaped lip 111 may have both at least one aperture 114F and bonding surface 114A applied to the second surface 114', both fixators/fasteners passing through the at least one aperture 114F and bonding surface 114A can work together to affix, attach, or otherwise come in retaining contact with a portion of décor. Reference to FIG. 10 may be had for an example of the descriptions in the paragraph above.

Now that the above has been mentioned, it should be apparent that in either instance where a moveable bracket 110 contains a "U" shaped lip 111 or not, the moveable bracket 110 contains a second surface 114' with other portions of the moveable bracket 110 operatively connected thereto. That said, the second surface 114' may also be known as a flat surface to receive a logo 114. As such, on a side of the surface 114/114' a logo may be placed thereon via adhesive sticker, embossing, etching, or other commonly employed means of affixing labels/designs to rigid and/or semi-rigid structures.

Figure 2:
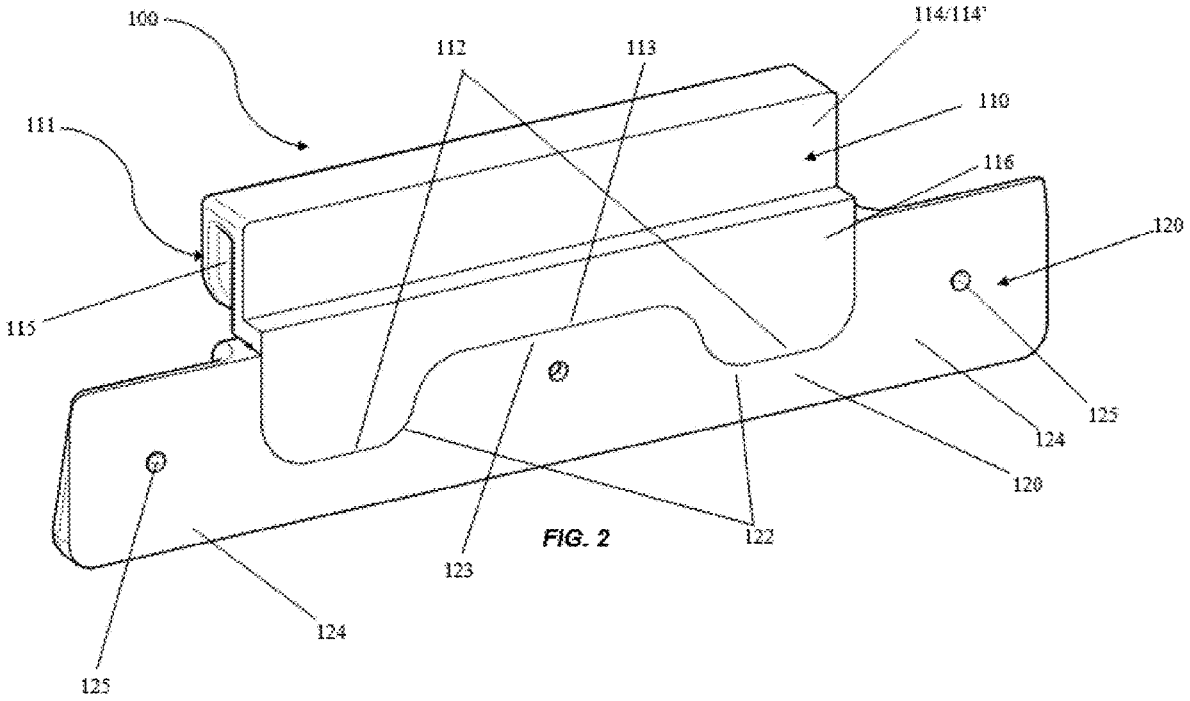
FIG. 2 is a rear perspective view of the vertical mounting assembly of FIG. 1.
Figure 3:
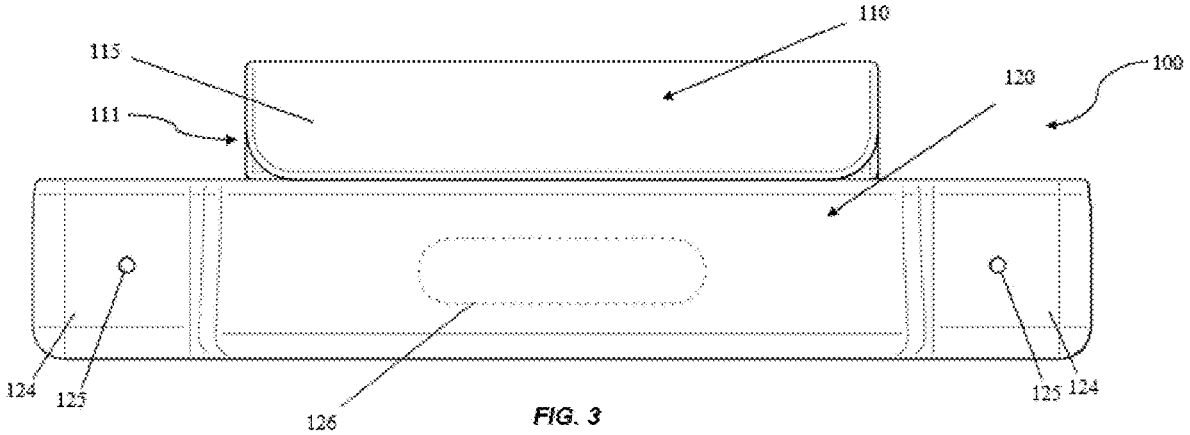
FIG. 3 is a front view of the vertical mounting assembly of the Figures above.
Figure 4:
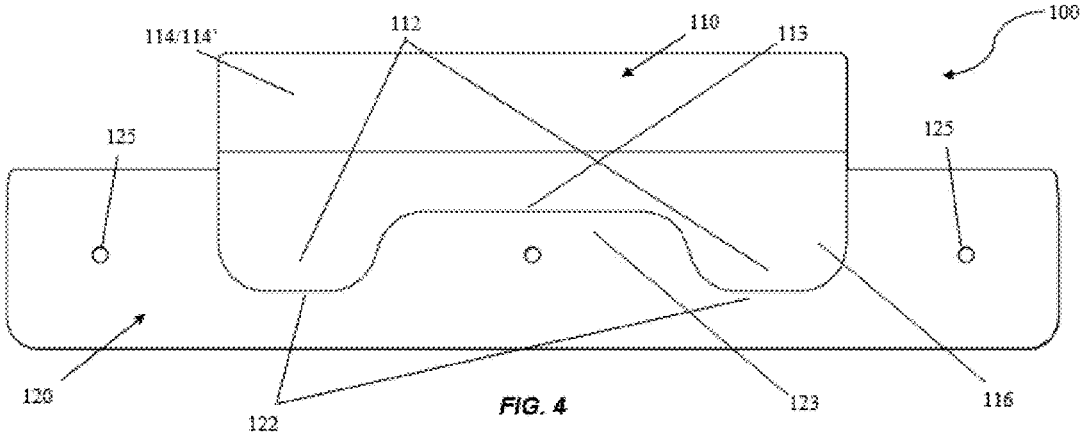
FIG. 4 is a rear view of the vertical mounting assembly of the Figures above.

At one portion of the surface 114/114' may be a perpendicular surface (as can be seen in the Figures), which may act as a partition or offset, spacing the second surface 114' and the first surface 116. With reference to FIG. 2, it can now be seen how the surface 114/114' is parallel to the first surface 116, but offset or spaced therefrom via the perpendicular surface, while connecting the two surfaces (114/114' and 116). As will be described in more detail, this spacing and orientation of the second surface 114' to the first surface 116 via a perpendicular surface aids in enhancing the visual appeal of décor hung from vertical surfaces or walls using the vertical mounting assembly 100. Further, upon the first surface 116, the flush fit tabs 112 and recessed groove 113 can be seen. The instant assembly 100 can allow for more than two flush fit tabs 112 or more than one recessed groove 113, but is depicted as having two flush fit tabs 112 and one recessed groove 113 herein.

With continued reference to FIG. 2, brief reference to FIG. 9, and with additional reference now to FIGS. 4-8, it can be noted that the flush fit tabs 112 and recessed groove 113 align with the flush fit grooves 122 and protruding tab 123 of the anchoring receiver 120 (where the instant assembly 100 can allow for more than two flush fit grooves 122 and more than one protruding tab 123). As such, it can be noted that the movable bracket 110 is inserted into the anchoring receiver 120 via the flush fit tabs 112 locking in place of the flush fit grooves 122 and the protruding tab 123 inserting into the recessed groove 113.

As will be described in more detail, this "flush fit" can enhance the visual appeal of décor hung from vertical surfaces or walls using the vertical mounting assembly 100. Further, this "flush fit" can allow for a user inserting the moveable bracket 110 (perhaps while the moveable bracket 110 as affixed to, attached to, or otherwise in retaining contact with a portion of décor) to quickly and easily slide the flush fit tabs 112 in place of the flush fit grooves 122 and allow the protruding tab 123 to insert into the recessed groove 113. To allow for such action, it may be noted that the anchoring receiver 120 may be anchored to, affixed to, or attached to a wall/vertical surface (as will be described). Thus, in essence, a user may easily slide the flush fit tabs 112 in place of the flush fit grooves 122 and allow the protruding tab 123 to insert into the recessed groove 113 via loosely lining up where there the flush fits tabs 112 may insert into the flush fit grooves 122 up against a wall or vertical surface, and, via positioning and moving the moveable bracket 110, allow the tabs 112 to become inserted into the grooves 122. In other words, the flush fit 122 grooves and protruding tab 123 allow for a "pocket" to be created, the flush fit tabs 1123 and recessed groove able to fill this pocket.

Further, and as can be seen in the Figures, the tabs 112, groove 113, groves 122, and tab 123 may have contoured or curved edges to allow for the tabs 112 to more naturally slide into place as each of the tabs 112, groove 113, groves 122, and tab 123 are moving along one another.

As may be apparent, the length, height, and width of the tabs 112, groove 113, groves 122, and tab 123 may be substantially equal or equally proportioned to allow for tight tolerances when the moveable bracket 110 is inserted into the anchoring receiver 120 (via tabs 112, groove 113, groves 122, and tab 123). Further, such tight tolerances and the orientation of the tabs 112, groove 113, grooves 122, and tab 123 can allow for the load of décor (now hanging from the anchoring receiver 120 via the moveable bracket 110) to be evenly distributed across the anchoring receiver such that even if a décor's center of gravity does not align with a vertical mounting assembly 100, the tabs 112, groove 113, groves 122, and tab 123 can still retain décor on a wall without the décor tilting to one side of the vertical mounting assembly 100 the décor is mounted on. Further, this tolerance and orientation can prevent décor (while on a wall/vertical surface via the instant assembly 100) from becoming lopsided or uneven when inadvertently bumped into or having a force applied thereto. As such, should a force (such as a bump, nudge, or environmental force like wind/earthquake) be applied to décor when the décor is making use of the instant assembly 100, the tabs 112, groove 113, grooves 122, and tab 123 may counter the force applied to the décor, allowing for the décor to remain upright, in place, and retain its original orientation when the tabs and groove 113 were originally slid into/filled the grooves 122 and tab 123.

Figure 5:
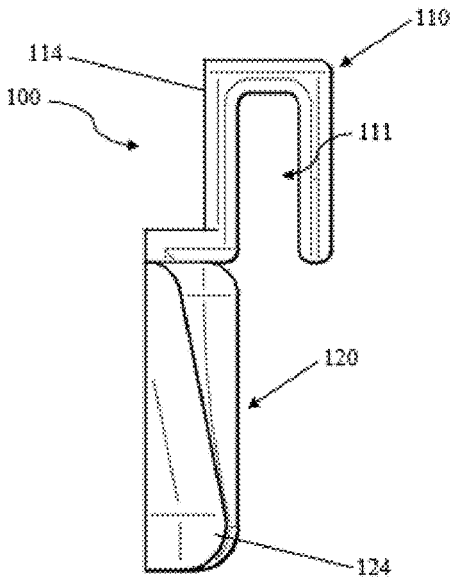
FIG. 5 is a side view of the vertical mounting assembly of the Figures above.
Figure 6:
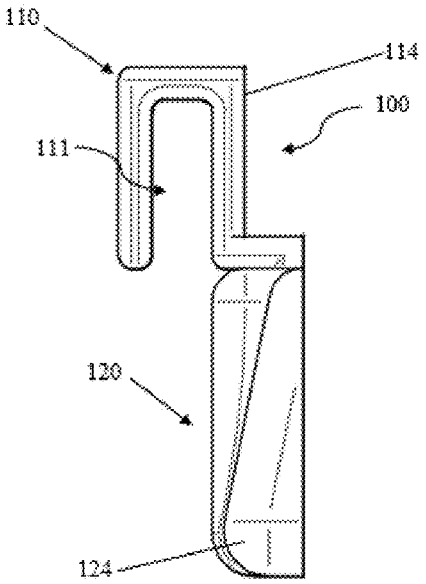
FIG. 6 is an alternative side view of the vertical mounting assembly of the Figures above.
Figure 7:
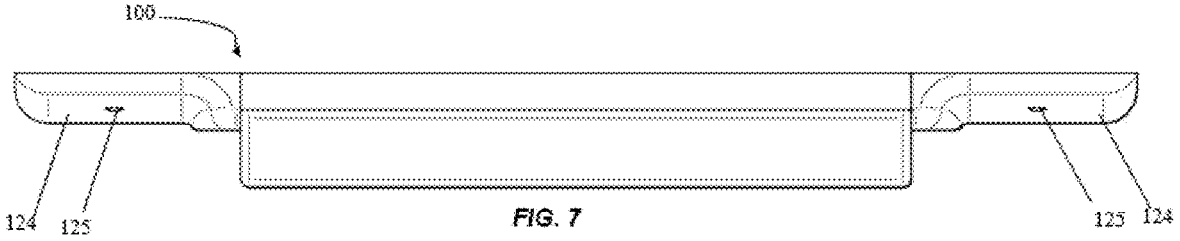
FIG. 7 is a top view of the vertical mounting assembly of the Figures above.
Figure 8:
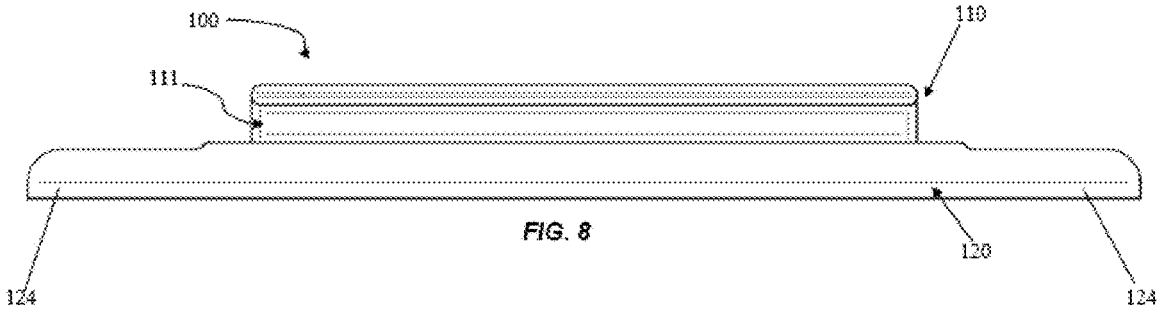
FIG. 8 is a bottom view of the vertical mounting assembly of the Figures above.

As such, considering the anchoring receiver 120, it should be noted that the flush fit grooves 122 and protruding tab 123 thus define a receptacle or "pocket", configured and dimensioned to receive the first surface 116 of the moveable bracket 110 (and therefore, the flush fit tabs 112 and recessed groove 113 thereof). With reference to FIGS. 5 and 6 This receptacle may thus have a dimensioning (with a depth that is approximately the depth of the perpendicular surface of the moveable bracket 110) that allows for the instant assembly 100 to have a minimal form factor when décor is hung using the assembly 100. This minimal form factor may be noted as allowing décor to appear parallel with a wall/vertical surface (where portions of the décor are not contact with a wall/vertical surface when other portions of the décor are in contact with a wall/vertical surface). In addition, this form factor allows for décor to be as close as possible to a wall/vertical surface to create the illusion that the entirety of one side of the décor (or a frame/plane thereof) is in contact with a wall/vertical surface (sometimes described as a "floating" effect).

Continuing, as for the anchoring receiver 120, it can be noted that, in addition to the flush fit grooves 122 and protruding tab(s) 123, the anchoring receiver 120 may comprise stabilizers 124, apertures in the stabilizers 125, a tool receiver 126, and a tool. As such, on either side of the receptacle (as mentioned above) may be stabilizers 124. Such stabilizers 124 may have load bearing geometry, such that when a movable bracket 110 (with décor attached thereto) is inserted into the anchoring receiver 120, the load is spread out (in a nominal fashion), such that the geometry of the stabilizers 124 absorbs and counteracts such load. In other words, the stress applied to the anchoring receiver 120 by décor is greater towards the bottom of the anchoring receiver when décor is affixed to the instant assembly 100. As a result, the geometry of the stabilizers help to absorb and counteract the nominal distribution of force so as to allow décor to appear as parallel with a wall/vertical surface (where portions of the décor are not contact with a wall/vertical surface when other portions of the décor are in contact with a wall/vertical surface). In addition, this geometry further allows for décor to be as close as possible to a wall/vertical surface to create the illusion that the entirety of one side of the décor (or a frame/plane thereof) is in contact with a wall/vertical surface. Also, the geometry prevents décor from sagging, tilting, or otherwise becoming unbalanced when the instant assembly 100 is in use with décor and a wall/vertical surface. Further, should a force (such as a bump, nudge, or environmental force like wind/earthquake) be applied to décor when the décor is making use of the instant assembly 100, the stabilizers 124 may counter the force applied to the décor, allowing for the décor to remain upright, in place, and retain its original orientation when the tabs 112 and groove 113 were originally slid into/filled the grooves 122 and tab 123.

Further, the stabilizers 124 may have apertures 125 in them. The apertures 125 can be configured and dimensioned to allow a fixator/fastener to pass through them (such as a nail, screw, or rivet) to allow the anchoring receiver 120 to become anchored to a wall/vertical surface. Such a strategic placement of the apertures 125 on the stabilizers 124 may also assist in distributing the load of décor (to achieve the aforementioned benefits).

Also, the anchoring receiver 120 may have a tool receiver 126 formed thereon/therein. This tool receiver 126 may allow for a tool (such as a bubble level or laser level) to be inserted into or otherwise be a part of the anchoring receiver 120. As such, the bubble level, being integrated into the anchoring receiver 120, allows for a user to level to receiver and anchoring the receiver to the wall (via using the apertures 125) with ease.

Lastly, each portion of the instant assembly 100 can be formed of environmentally friendly materials, such as biodegradable materials, be printed from a three-dimensional printer, be extruded, forged, or be blown or molded of traditional manufacturing means.

Now that the foregoing has been described, the following provides an example of one use of a vertical mounting assembly 100. A homeowner decides to hang a series of framed photographs (décor) in their living room, which has recently been renovated with fresh drywall and painted surfaces. The homeowner chooses the vertical mounting assembly 100 for its simplicity and damage-minimizing installation process.

Using a level integrated into each anchoring receiver 120's tool receiver 126, the homeowner drives drywall nails through the apertures 125 in the stabilizers 124 of each anchoring receiver 120 to secure the receivers 120 to the wall while the level reads level. This level feature is important here, as it allows the homeowner to ensure that each anchoring point is perfectly horizontal, eliminating the usual guesswork and use of external tools. Further, the feature allows the receivers 120 to provide for a robust foundation that can evenly distribute the load of décor, thanks to the chamfered, load-bearing design of the stabilizers 124.

Continuing from the installation of the anchoring receivers 120, the next step involves attaching the décor to the movable brackets 110. Each movable bracket is designed with a U-shaped lip 111, sized to grip the mat board of the frames securely. This design is particularly advantageous because it allows for quick attachment without the need for additional tools or hardware that might damage the frame. The homeowner simply slides the frame's edge into the U-shaped lip until it sits flush against the flat surface 115, which is designed to tuck behind the frame. This not only secures the frame but also ensures that it hangs flush against the wall, enhancing the aesthetic appeal by eliminating any gaps between the frame and the wall. The mat board can then easily be reattached/reinserted into the frame.

In the case of a larger, heavier piece of decor like a mirror, the homeowner uses a movable bracket 110 that lacks the U-shaped lip but features a second surface 114' with bonding surface 114A and an aperture for a fastener 114F. This design is ideal for items that cannot be gripped along the edges (by the U-shaped lip 111). The homeowner applies the bonding surface 114A (which makes use of adhesive) of the bracket directly to the back of the mirror and secures it further with screws through the apertures 114F, ensuring a firm hold. This arrangement not only provides the necessary support for the heavier item but also maintains the aesthetic integrity of the decor by hiding the mounting mechanism behind the item.

To finalize the attachment of the décor to the vertical mounting assembly 100, the homeowner aligns the flush fit tabs 112 of each movable bracket 110 with the corresponding flush fit grooves 122 in the anchoring receivers 120. With a gentle push, the movable brackets slide into place, the tabs snapping securely into the grooves. This action is facilitated by the curved and precise dimensioning of the tabs and grooves, which are designed to interlock seamlessly and with tight tolerances, providing a stable and secure hold. The protruding tab 123 fits snugly into the recessed groove 113, ensuring that once locked in, the frames are resistant to accidental bumps or shifts. The simplicity of this mechanism not only saves time but also reduces the stress typically associated with hanging art, as it guarantees that each frame is perfectly level and securely mounted without the need for constant adjustments.

The flush fit design between the tabs 112 and grooves 122 ensures that each piece of décor sits perfectly parallel to the wall, providing a clean and professional appearance. This alignment is further enhanced by the load-bearing design of the stabilizers 124, which distribute the weight of the décor evenly across the wall surface. This not only prevents sagging but also maintains the desired orientation of the décor over time, eliminating the need for frequent readjustments. The built-in tool receiver 126 with its leveling capability plays a vital role in this process, as it enables precise leveling during the initial installation, ensuring that each piece of décor is aligned both horizontally and vertically. This integrated leveling feature simplifies the setup process and enhances the overall stability and aesthetic alignment of the mounted décor.

Since many modifications, variations and changes in detail can be made to a vertical mounting assembly, it is intended that all matters in the foregoing description and shown in the accompanying drawings be interpreted as illustrative and not in a limiting sense.

What is claimed is:

1. A vertical mounting assembly comprising:

a movable bracket comprising a "U" shaped lip configured and dimensioned to receive a portion of décor;

an anchoring receiver configured and dimensioned to receive said moveable bracket; said moveable bracket further comprising at least two flush fit tabs spaced apart by a recessed groove; and said anchoring receiver further comprising at least two flush fit grooves spaced apart by a protruding tab where said at least two flush fit grooves are configured and dimensioned to receive said at least two flush fit tabs and said protruding tab is configured and dimensioned to fill said received groove.

2. The vertical mounting assembly of claim 1 wherein said moveable bracket and said anchoring receiver are formed from sustainable materials.

3. The vertical mounting assembly of claim 1 wherein the width of said at least two flush fit grooves spaced apart by said protruding tab is equal to said at least two flush fit tabs and said recessed groove.

4. The vertical mounting assembly of claim 1 wherein said moveable bracket further comprises a flat surface upon at least one side of said "U" shaped lip wherein said flat surface is configured and dimensioned to receive a logo.

5. The vertical mounting assembly of claim 4 wherein said moveable bracket's said at least two flush fit tabs and recessed groove are connected to, yet run vertically parallel to said flat surface upon at least one side of said "U" shaped lip configured and dimensioned to receive a logo.

6. The vertical mounting assembly of claim 4 wherein said moveable bracket further comprises a flat surface upon at least one side of said "U" shaped lip configured and dimensioned to be tucked behind a portion of décor.

7. The vertical mounting assembly of claim 1 wherein said "U" shaped lip is configured and dimensioned to receive a portion of décor.

8. The vertical mounting assembly of claim 1 wherein said anchoring receiver comprises at least one stabilizer on each side of the structure formed by the said at least two flush fit grooves spaced apart by said protruding tab.

9. The vertical mounting assembly of claim 7 wherein said at least one stabilizer comprises an aperture configured and dimensioned to receive a fastener.

10. The vertical mounting assembly of claim 8 wherein said at least one stabilizer further comprises a chamfered, load bearing geometry.

11. The vertical mounting assembly of claim 1 wherein said anchoring receiver further comprises a tool receiver.

12. The vertical mounting assembly of claim 11 wherein said tool receiver is configured and dimensioned to receive a leveling device.

13. A vertical mounting assembly comprising:

a movable bracket comprising a first surface and a second surface, said first surface parallel to and operatively connected to said second surface via a perpendicular surface;

an anchoring receiver configured and dimensioned to receive said moveable bracket;

said first surface of said moveable bracket further comprising at least two flush fit tabs spaced apart by a recessed groove; and said anchoring receiver comprising at least two flush fit grooves spaced apart by a protruding tab, said at least two flush fit grooves configured and dimensioned to receive said at least two flush fit tabs and said protruding tab configured and dimensioned to fill said recessed groove.

14. The vertical mounting assembly of claim 13 wherein said second surface further comprises a bonding surface on at least one side of said second surface.

15. The vertical mounting assembly of claim 13 wherein said second surface further comprises at least one aperture to allow for a fastener to pass through said second surface and affix said moveable bracket to at least a portion of décor.

16. The vertical mounting assembly of claim 13 wherein said anchoring receiver comprises at least one stabilizer on each side of the structure formed by the said at least two flush fit grooves spaced apart by said protruding tab.

17. The vertical mounting assembly of claim 16 wherein said at least one stabilizer comprises at least one aperture configured and dimensioned to receive a fastener and wherein said at least one stabilizer further comprises a chamfered, load bearing geometry.

* * * * *